US006820721B1

(12) United States Patent
Henson

(10) Patent No.: US 6,820,721 B1
(45) Date of Patent: Nov. 23, 2004

(54) RESCUE APPARATUS

(75) Inventor: William E. Henson, Otter Lake, MI (US)

(73) Assignee: American Escape Systems, Inc., Rochester Hills, MI (US)

( * ) Notice: Subject to any disclaimer, the term of this patent is extended or adjusted under 35 U.S.C. 154(b) by 0 days.

(21) Appl. No.: 10/326,355

(22) Filed: Dec. 23, 2002

(51) Int. Cl.[7] ..... A47L 3/04

(52) U.S. Cl. ..... 182/5; 182/7; 182/193; 188/65.2

(58) Field of Search ..... 182/5–7, 72, 193, 182/231, 133; 188/65.2, 65.4, 65.5; 119/96, 857; 244/151 R

(56) References Cited

U.S. PATENT DOCUMENTS

| | | | | | |
|---|---|---|---|---|---|
| 612,673 | A | | 10/1898 | Reidy et al. | |
| 634,604 | A | * | 10/1899 | Asche | 182/5 X |
| 859,266 | A | | 7/1907 | Ulery | |
| 3,250,515 | A | * | 5/1966 | Hudnall et al. | 182/5 |
| 3,717,219 | A | * | 2/1973 | Hoffman | 182/6 |
| 4,077,094 | A | * | 3/1978 | Swager | 24/134 R |
| 4,114,726 | A | * | 9/1978 | Sentinella | 182/5 |
| 4,171,795 | A | | 10/1979 | Bianchi | |
| 4,476,956 | A | * | 10/1984 | Eger | 182/5 |
| 4,550,801 | A | * | 11/1985 | Forrest | 182/7 |
| 4,580,658 | A | * | 4/1986 | Brda | 182/5 |
| 4,690,381 | A | * | 9/1987 | Asai | 254/394 |
| 4,825,471 | A | * | 5/1989 | Jennings | 2/94 |
| 5,145,028 | A | * | 9/1992 | Wu | 182/5 |
| 5,360,082 | A | * | 11/1994 | Bell | 182/3 |
| 6,029,777 | A | * | 2/2000 | Rogelja | 182/193 |
| 6,095,613 | A | * | 8/2000 | Ostrander et al. | 297/467 |
| 6,283,248 | B1 | * | 9/2001 | Groover | 182/6 |
| 6,367,582 | B1 | * | 4/2002 | Derby | 182/3 |
| 6,371,244 | B2 | | 4/2002 | Okamura | |
| 6,487,725 | B1 | * | 12/2002 | Jordan | 2/94 |
| 2003/0051944 | A1 | * | 3/2003 | Shea | 182/193 |
| 2003/0172431 | A1 | * | 9/2003 | Allen | 2/69 |

* cited by examiner

*Primary Examiner*—Bruce A. Lev
(74) *Attorney, Agent, or Firm*—Alex Rhodes

(57) ABSTRACT

An easy to use and easy to store rescue apparatus for lowering a person from an upper level to a lower level during an emergency. The rescue apparatus is comprised of a body harness and a decender mounted on a chest portion of the harness in plain view of a wearer. In a first aspect of the invention, a descender is stored in a vertical pocket of the body harness. A rope is tightly coiled inside of the descender and as the rope is withdrawn it passes through a friction core which limits a rate of descent and removes twists from the portion of the rope which is in the process of withdrawal. A camshaft is provided in the decender for accommodating differences in body weight and satisfying the preferences of wearers of the apparatus. In a second aspect of the invention, the decender is attached and exposed the chest portion of the harness. In a third aspect of the invention, an alternate descender is attached to the same body harness in the same manner as the second aspect.

11 Claims, 5 Drawing Sheets

RESCUE APPARATUS

FIELD OF THE INVENTION

This invention relates to a rescue apparatus and more particularly to an improved, moderately priced and easy to use apparatus for rescuing persons from upper levels during emergencies.

BACKGROUND OF THE INVENTION

Descenders are used during emergencies to lower people from upper levels when traditional forms of escape are unavailable. They are also used with helicopters to dispatch troops into battles and are standard equipment of sportsmen and workers, such as mountain climbers, window washers, iron workers and tree trimmers.

The emergencies in which descenders are used include broken scaffolds, fires, tornados, earthquakes, floods and terrorist attacks. Traditional forms of escape include, doors, stairs, elevators and ladders. Very few commercial buildings and residences are equipped with descenders to permit persons to immediately escape during emergencies. Upper floors of high buildings exceed the rescue capability of firefighters' ladders. The trend of constructing higher and higher commercial and residential buildings has increased the need for improved descenders for evacuating high office buildings, municipal buildings, hospitals, apartments and condominiums during emergencies. A need also exists in rural areas where firefighting equipment is not readily available.

A variety of descenders, ranging from simple to complex descenders, exist in the prior art. Some, such as, the descenders of sportsmen and workers, are generally simple devices but require training and skill. Others, such as descenders which are capable of lowering individuals, particularly elderly and physically impaired persons, are generally costly and complex. Some are suitable for only low heights. Others are difficult to store. Still others lack adjustments for rates of descent. Adjustments for rates of descent are important to accommodate differences in individual weights, which can vary from the weight of a young child to the weight of a mature male. U.S. Pat. Nos. 3,220,511; 5,038,888; 4,550,801; 3,949,832; and 3,250,515 are exemplary of the types of descenders which exist in the prior art.

In my co-pending U.S. patent application Ser. No. 10/279616, a descender is disclosed having numerous benefits over the prior art. One benefit is that it requires little, if any, training to use. Another benefit is that it is compact and can be stored in spaces which are available in existing equipment, such as file cabinets, desks, closets and dressers. Still yet another benefit is that it is moderate in cost. Still yet another benefit is that it is capable of rescuing persons from high places. Still yet another benefit is that it incorporates an easy to use adjustment for a rate of descent.

Numerous harnesses exist for rescuing people during emergencies. One drawback of some of existing harnesses is that they have long belts. Long belts are easy to tangle and are subject to being improperly installed. Another drawback of some harnesses is that elderly and physically impaired persons are incapable of installing them and require assistance. Another drawback of some is that they require prior training. Known body harnesses are exemplified by U.S. Pat. Nos. 6,367,582; 3,424,134; and 5,329,884. In my co-pending U.S. patent application Ser. No. 10/281639 an improved, easy to use body harness is disclosed which has only three relatively short straps. It requires little, if any, training and cannot be improperly installed. Still yet another benefit is that it has a pocket for storing a rope or descender.

SUMMARY OF THE INVENTION

The primary object of the present invention is to provide a rescue apparatus which is ready for immediate use, easy to use and quickly installed. Another object is to provide a rescue apparatus which is moderate in price. Still yet another object is to provide a rescue apparatus for rescuing persons from high places, such as the upper floors of tall apartments, office buildings and condominiums. Still yet another object is to provide an improved and easy to use means for adjusting a rate of descent. Still yet another object is to provide a rescue apparatus which can be stored in available spaces of equipment, such as file cabinets, desks and bedroom dressers. Still yet another object is to provide a rescue apparatus which is applicable to individuals, workers, sportsmen and military troops.

With the numerous above objects in mind, a moderately priced, ready to use rescue apparatus is provided which is comprised of a descender stored in a chest portion of a body harness. The harness and descender can be stored in available spaces of equipment, such as bedroom dressers, office desks, and office file cabinets.

In a first aspect of the invention, a three point body harness of the rescue apparatus includes a closed pocket for storing a rope and/or a descender. As used herein, the expression "three point" refers to the number of connections which a wearer must make to attach the body harness. Another distinguishing feature of the invention is a rope, stored in closely stacked coils in the interior of the descender. Another distinguishing feature is a means for removing twists from the coiled rope as it is withdrawn from the descender.

The novel untwisting feature increases the amount of rope which can be stored in the descender. Another important advantage of the descender is that there are no moving parts. The absence of moving parts provides a high level of reliability, particularly if the descender has been stored for a long time. Moving parts which have been stored may corrode from moisture and cause a descender to malfunction. Another important advantage is that it is affordable to a large number of potential purchasers.

In a second aspect of the invention, a descender is exposed and attached to a body harness with a pair of bosses and a tang. The bosses to the body harness with a transverse usual type of quick release pin. The tang engages an open pocket of the harness which lies below the bosses. The bosses retain an upper portion of the descender to the harness and the tang retains a lower portion of the descender to the harness.

In a third aspect of the invention, an alternate embodiment of the descender is attached to a body harness in the same manner as the second aspect.

In employing the teaching of the present invention, a plurality of alternate constructions can be provided to achieve the desired results and capabilities. In this disclosure, some alternate constructions are discussed. However, these embodiments are intended as examples and should not be considered as limiting.

Further objects, benefits and characterizing features of the invention will become apparent from the ensuing detailed description and drawings which illustrate and describe the invention. The best mode which is contemplated in practicing the invention together with the manner of using the invention are disclosed and the property in which exclusive rights are claimed is set forth in each of a series of numbered claims at the conclusion of the detailed description.

BRIEF DESCRIPTION OF THE DRAWINGS

The invention will be better understood and further objects, characterizing features, details and advantages thereof will appear more clearly with reference to the diagrammatic drawings illustrating a preferred embodiment of the invention by way of non-limiting example only.

DETAILED DESCRIPTION OF A PREFERRED EMBODIMENT

Figure 1:
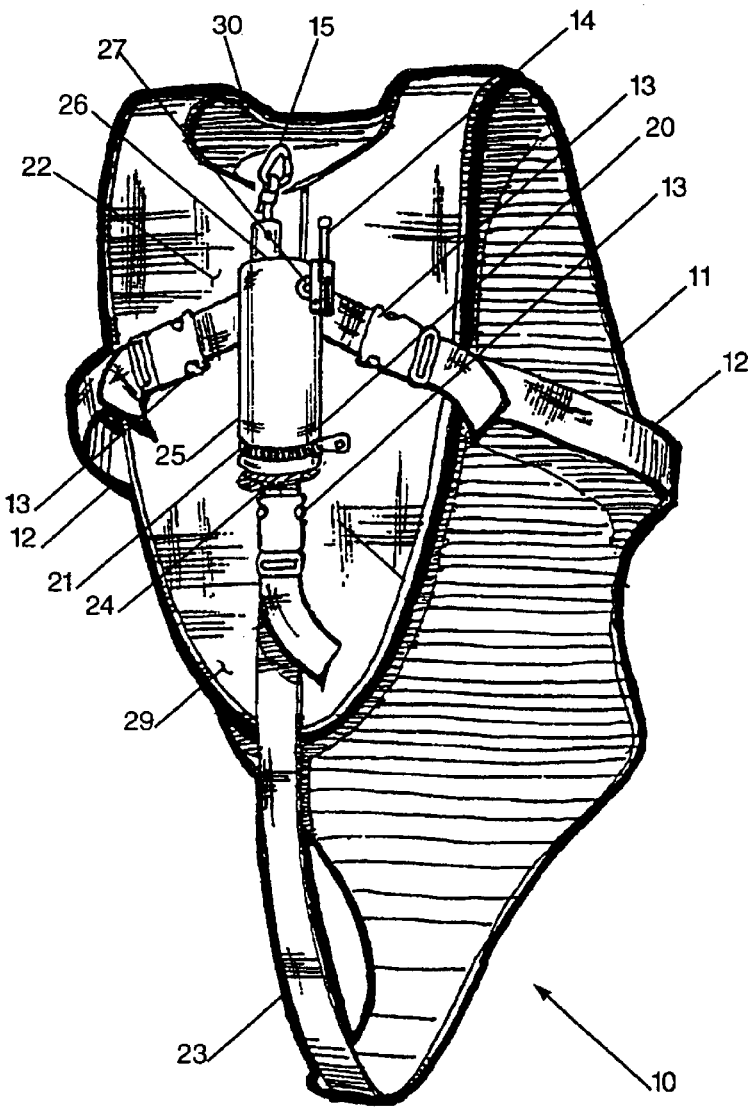
FIG. 1 is a perspective view of a rescue apparatus according to the present invention.

Referring now to the drawings wherein numerals designate like and similar parts throughout the several drawings, a first aspect 10 of an improved rescue apparatus which is exemplary of the invention is shown in FIGS. 1 through 4, inclusive. The first aspect 10 is intended to be applicable to residences, commercial buildings, such as hotels, hospitals and office buildings,as well as workers, sportsmen and military troops.

Figure 2:
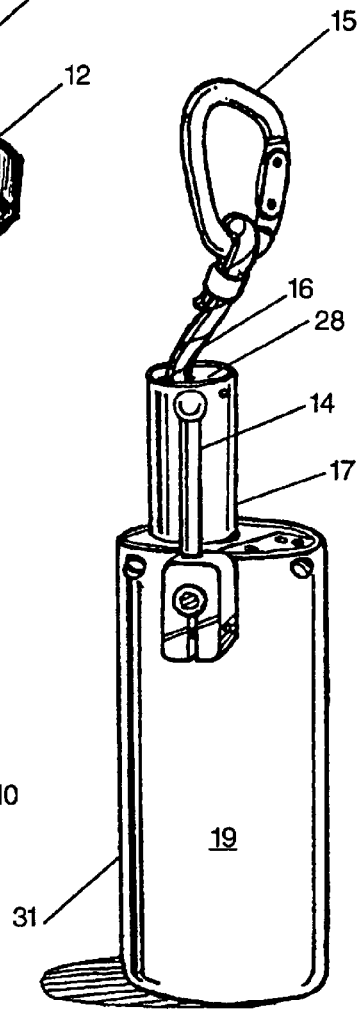
FIG. 2 is an enlarged perspective view of a descender only.
Figure 3:
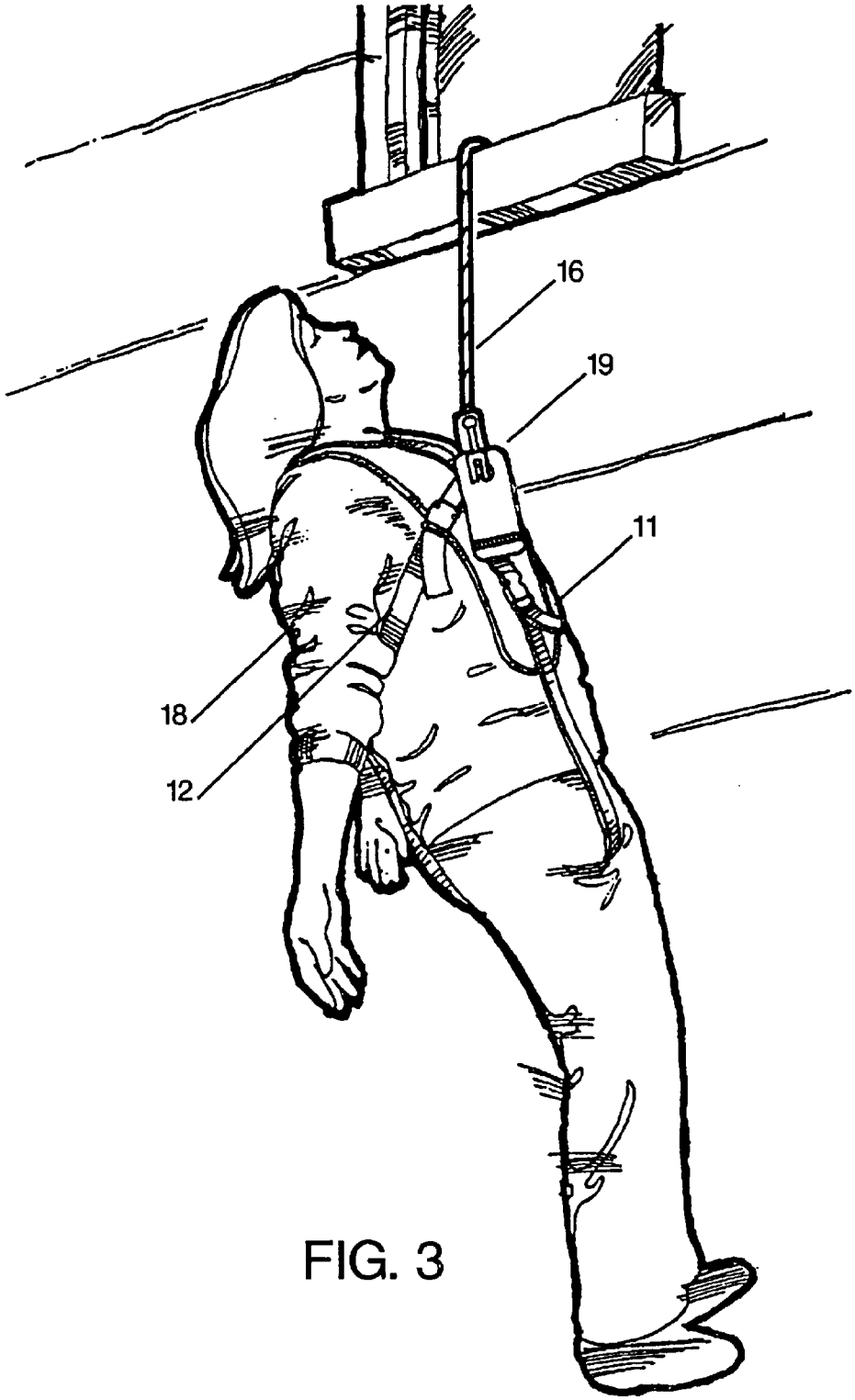
FIG. 3 is perspective view of a woman during a descent with the apparatus.

In the first aspect of the present invention, shown in FIGS. 1 through 4, inclusive, a generally cylindrical descender 19 is stored in a pocket 20 of a body harness 11. The body harness 11 is a three point body harness 11 which is disclosed in my co-pending application serial number 10/281639 that is incorporated herein by reference. In FIG. 3 the rescue apparatus 10 is shown mounted on a woman 18 during a rescue.

One distinguishing feature of harness 11 is the three point mounting system that is comprised of only three straps 12, 23, i.e. two torso straps 12 and one crotch strap 23. Another distinguishing feature is the locations of buckles 13 which connect portions of the straps 12, 23. The buckles 13 are adjacent to a chest portion 22 of the harness 11. This allows a person 18 to easily buckle, adjust, and unbuckle the straps 12, 23. It also allows the person 18 to observe whether all of the straps 12, 23 have been properly buckled. This is not the case with other harnesses.

Another distinguishing feature of the harness 11 is a closed cylindrical pocket 20 on the chest portion 22 of the harness 11 for storing a rope or descender 19. A bottom portion 24 of the pocket 20 is attached to a side portion 25 of the pocket 20 with a zipper 21. The zipper 21 is used to install the descender 19. At the top of the pocket 20 there is an aperture 26 through which a friction core 28, which will be later described, extends. At a side of the pocket 20 there is an aperture 27 through which a means for adjusting a rate of descent extends.

The harness 11 consists of a one-piece generally oval shaped vest 29 and the three straps 12, 23 which constitute a vest retaining portion. Each strap 12, 23 is divided into two portions which are connected by buckles 13. On an upper portion of the harness 11 there is an aperture 30 for passing the person's head when the harness 11 is attached. The harness 11 is easy to install, and requires little, if any training or instructions because the manner of installing the harness 11 is rather obvious. Moreover, the harness cannot be improperly installed. A further benefit is that it can be quickly installed.

Figure 4:
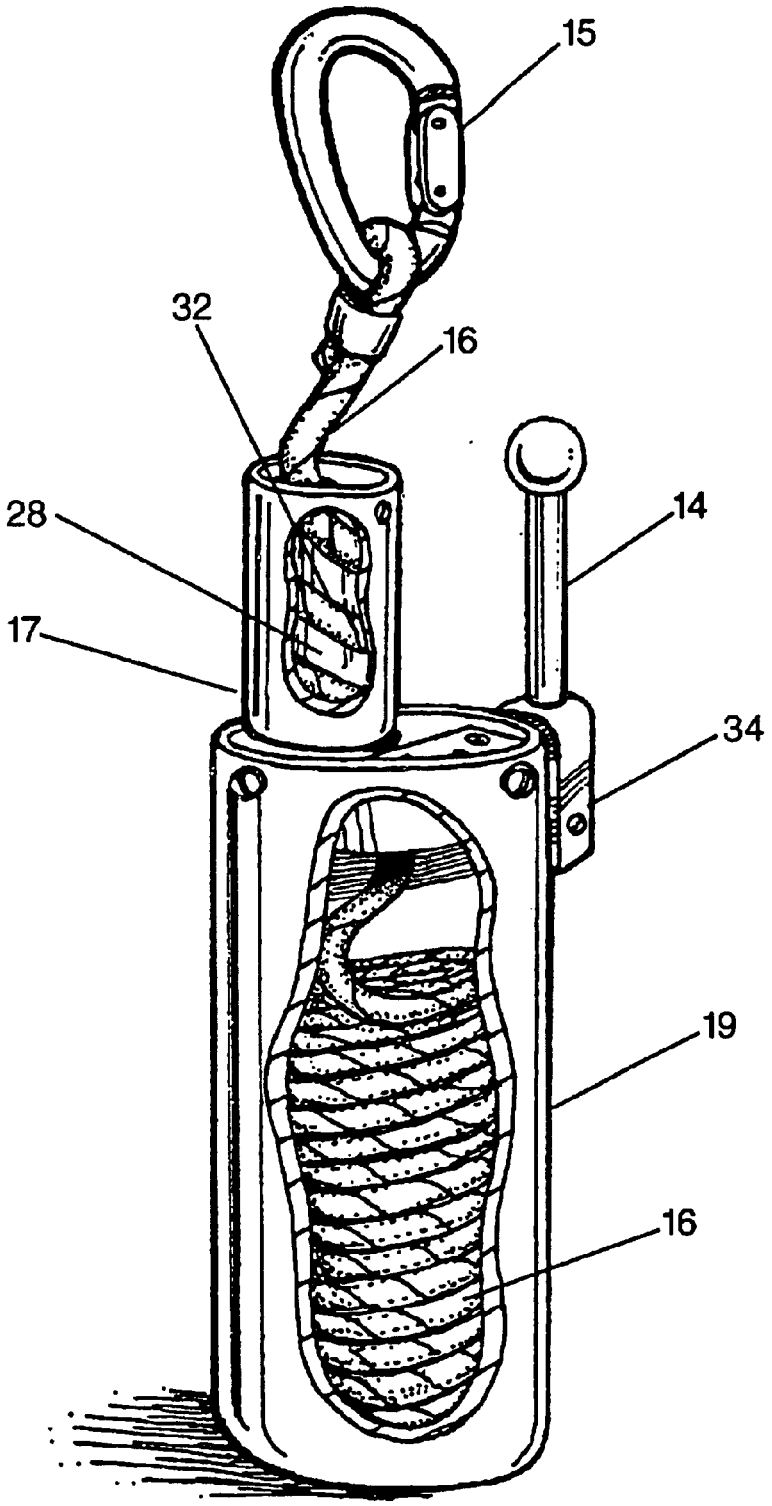
FIG. 4 is a broken perspective view showing the interior of the descender.

With reference to FIGS. 2 and 4, the descender 19 is a generally cylindrical descender comprised of a housing 31, the upward extending-cylindrical friction core 28, the rope stored inside the housing 31 and the means 34 for adjusting the rate of descent. At a distal end of the rope there is a carabiner 15 for attaching the first aspect 10 to a building or object within a building, such as a window bar (not-shown). The descender of FIGS. 1 through 4 is fully disclosed in my co-pending U.S. application Ser. No. 10/279,616, which is incorporated herein by reference.

Referring now to FIG. 4, the rope 16 is stored within the housing 31 in a compact closely stacked vertical arrangement of layers of coils. The manner of arranging the coils allows sufficient rope 16 to be stored for descents from upper floors of tall buildings. For workers who do not require descents to ground levels and descents from second floors of residences, very small descenders 19 with less rope 16 can be provided.

The friction core 28, which in itself is believed to be novel, is an important feature of the rescue apparatus 10. It has a dual function. One function is to control the rate of descent by providing a given amount of friction on the rope 16 as it passes through the friction core 28. The second function is to remove twists from the rope 16 as the rope 16 is withdrawn from the descender 19. The friction core 28 was the solution to the problem of storing sufficient rope 16 for making descents from high places. Without the friction core 28, the rope 16 will hopelessly twist inside the descender 19 as it is withdrawn.

The friction core 28 provides friction and uncoils the rope 16 as it is withdrawn in the following manner. On an outer portion of the friction core 16 there is a helical groove 32. The length of the helical groove 32 is same as the average length of the twists of the coils of rope which are withdrawn from the descender. As the layers of coils are withdrawn, the opposite hand helix cancels the twists in the layer as it is withdrawn from the descender 19. Thus, the helical groove 32 serves the dual function of slowing the rate of descent and untwisting the rope which is withdrawn from the descender 19. The friction core 28 is surrounded by a thin wall sleeve 17.

On an upper portion of the friction core 28 there is a handle 14 for adjusting the rate of descent. The handle 14 rotates an internal cam (not shown) to adjust the rate of descent. When the handle 14 is rotated in a clockwise direction, the cam bears against a portion of the rope 16 to decrease the rate of descent. When the cam is fully disengaged from the rope 16, there is sufficient friction to prevent an excessive rate of descent.

Figure 5:
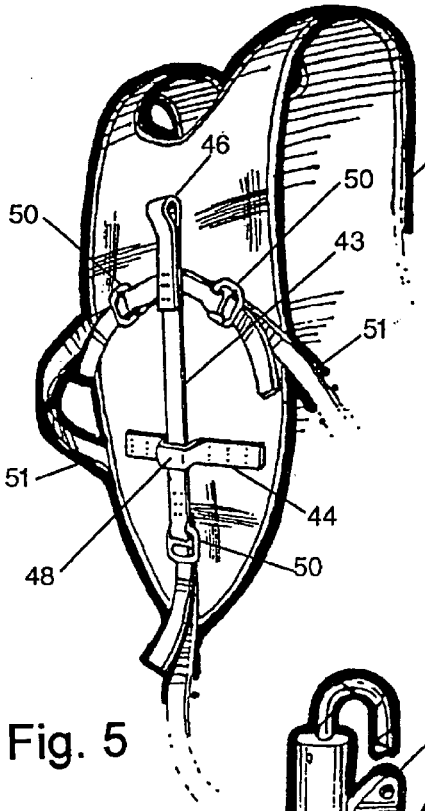
FIG. 5 is a perspective view of an alternate embodiment of a body harness of the first embodiment.
Figure 7:
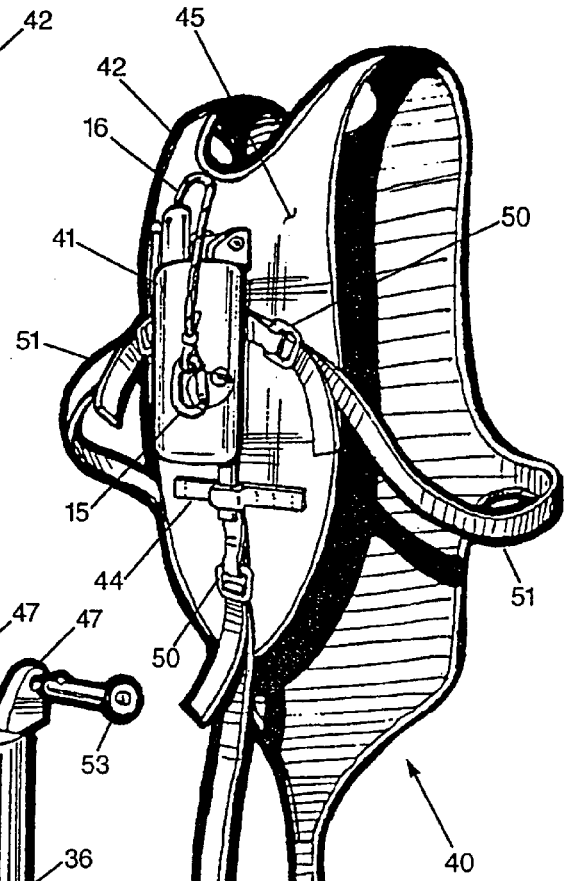
FIG. 7 is a perspective view of a second aspect of the rescue apparatus which is comprised of the body harness shown in FIG. 5 and the descender shown in FIG. 6.
Figure 6:
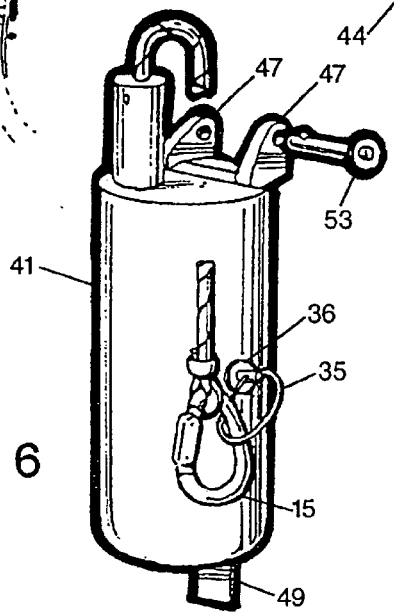
FIG. 6 is an enlarged exploded perspective view of an alternate embodiment of a descender.

With reference to FIGS. 5 through 7, inclusive, a second aspect 40 of my invention is shown wherein an exposed descender 41 is attached to a body harness 42 with a transverse pin 53 and a downward extending vertical tang 49. The descender 41 and body harness 32 are similar to the first aspect except for the following differences. One major difference is the method of attaching the descender 41 to the harness 42. The transverse pin extends through a pair of bosses 47 which straddle a folded over loop portion 46 of a vertical strap 43. The downward extending vertical tang 49 engages a spaced apart center portion 48 of a horizontal strap 44. The open center portion 48 of the strap forms a pocket for receiving the tang 49.

Another difference is that the buckles 13 of the first aspect 10 are eliminated and replaced with belt adjusters 50. The harness 42 is provided as shown in FIGS. 5 and 7 with the straps 50, 51 connected and sufficient slack in each of the straps to attach the harness 42 on a person without dividing the straps 50, 51.

Still yet another difference is that the carabiner 15 at the distal end of the rope 16 is attached to a detachable pin 36 with a wire 35 to prevent an inadvertent withdrawal of the rope 16 before an emergency. When the rescue apparatus 40 is placed in service, the carabiner 15 is freed for service by withdrawing the pin 36.

The manner of attaching the descender 41 to the harness 42 is readily apparent from FIGS. 5 through 7. The tang 49 is inserted into the pocket 48 of the horizontal strap 44, the descender 41 is placed adjacent to the harness 42 and the pin 53 is passes through the pair of bosses 47 and the loop portion 46 of the vertical strap 43. The pin 53 is preferably a readily available quick disconnect type pin to allow the person 18 to quickly detach herself from the descender 41.

Figure 8:
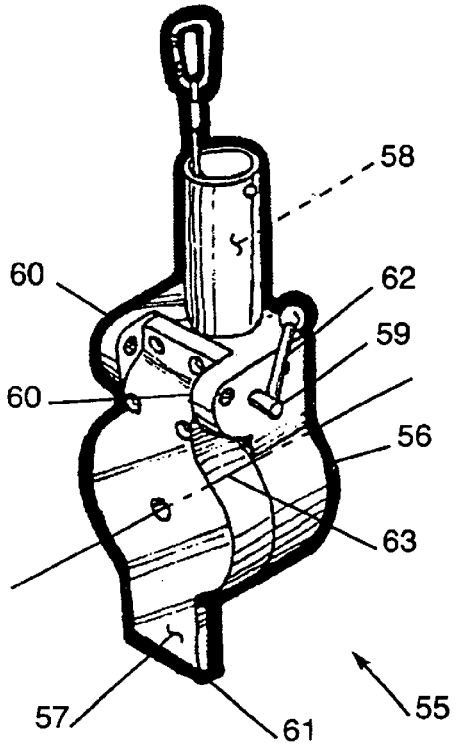
FIG. 8 is an enlarged perspective view of an alternate embodiment of a descender.
Figure 9:
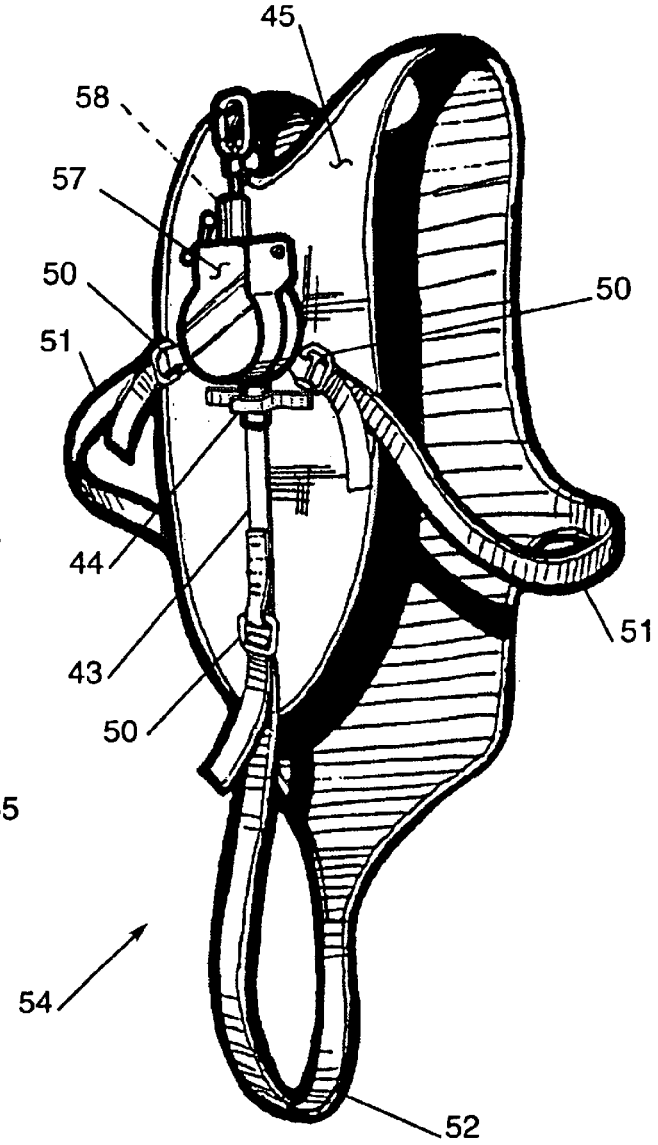
FIG. 9 is a perspective view of a third aspect of the rescue apparatus which is comprised of the body harness shown in FIG. 5 and the descender shown in FIG. 8.

In FIGS. 8 and 9, a third aspect 54 of my invention is shown which is similar in all respects to the second aspect 40 except for the descender 55. The descender 55 shown in FIGS. 8 and 9 is the subject of a separate co-pending application Ser. No. 10/322,864 which is incorporated herein by reference. The descender 55 is comprised of a two part housing 56, a spool (not shown) rotatably mounted in the housing 56 having a horizontal axis of rotation 63 which is orthogonal to a front face 57 of the housing 56; a rope (not shown) stored on the spool; a friction core 58 and a camshaft 59 for adjusting the rate of descent of the descender 55.

The friction core 58 serves only to limit the rate of descent there not being a need to remove twists from the rope. The provisions for mounting the descender 55 on the body harness 50 are the same as the second aspect 40, namely, a pair of bosses 60 on an upper portion 45 of the descender 55 and a downward extending tang 61 on a lower portion of the descender 55.

On a side of the housing there is a handle 62 which rotates the camshaft 59. In a similar manner to the previously described descenders, the rotation of the handle 62 increases or decreases the rate of descent.

From the foregoing, it is apparent that the present invention is an improved rescue apparatus with many benefits and advantageous over the prior art. Although only several aspects of my invention have been described for purposes of disclosing my invention, it will be appreciated that other embodiments can be derived by such obvious changes as changes in shape, eliminations, substitutions, inversions, and re-arrangement of parts without departing from the spirit thereof.

I claim:

1. In combination with a body harness having a vest portion for covering a chest and a back of a wearer of said harness, said chest covering portion having a means for attaching and storing a descender apparatus, a descender apparatus stored in said chest covering portion for lowering a person from an elevated position to a lower position, said descender apparatus having a pair of bosses on an upper portion of said descender apparatus for attaching said descender apparatus to said vest and a downward extending tang portion on a lower portion of said descender apparatus for attaching said lower portion of said descender apparatus to said vest; and a rope having an end portion initially extending out of an upper end portion of said descender apparatus by a small amount and a remaining portion stored in an interior of said descender apparatus, said rope being withdrawn from said descender apparatus during said lowering of said person and having a means on said end portion for attaching said rope to said elevated position.

2. The combination recited in claim 1 wherein said means for attaching said descender apparatus to said chest covering portion comprises an upper open loop portion for receiving a transverse pin and a lower open pocket portion on said chest covering portion for engaging said downward extending tang portion of said descender apparatus.

3. The combination recited in claim 1 wherein said descender apparatus is a generally cylindrical shaped descender apparatus and said rope is stored in said descender apparatus in a closely stacked vertical arrangement of layers of coils.

4. The combination recited in claim 3 wherein said descender apparatus further comprises a means for uncoiling said rope as said rope is withdrawn from said descender apparatus.

5. The combination recited in claim 1 wherein said descender apparatus further comprises a means for enabling said person to adjust a rate of descent of said person.

6. The combination recited in claim 1 further comprising a three point mounting system for attaching said harness to said person, said three point mounting system including a pair of torso straps and a single crotch strap.

7. In combination with a body harness having a vest portion for covering a chest and a back of a wearer of said harness comprised of: a generally cylindrical shaped descender apparatus for lowering and controlling a rate of descent of a person from an elevated position to a lower position comprised of a cylindrical housing, said cylindrical housing having an axis in orthogonal relationship to said chest covering portion of said vest and a face portion in parallel relationship to said chest covering portion of said vest and a pair of bosses on an upper portion of said housing for attaching said upper portion of said descender apparatus to said vest and a downward extending tang portion on a lower portion of said descender apparatus for attaching said lower portion of said descender apparatus to said vest; a spool rotatably mounted in said housing, said spool having an axis of rotation in orthogonal relationship to said front face of said housing; and a rope stored on said spool and having an end portion initially extending out of an upper portion of said descender apparatus with a remaining portion stored in an interior of said descender apparatus and withdrawn from said descender apparatus during said lowering of said person.

8. The combination recited in claim 7 further comprising a means in said descender apparatus for adjusting a rate of descent of said person during said lowering of said person, said means comprising a rotatable camshaft in parallel relationship to said front face of said descender, said camshaft having a cam for increasing and decreasing friction on said rope by a rotation of said camshaft.

9. The combination recited in claim 7 wherein said descender apparatus further comprises a cylindrical friction core attached to an upper portion of said descender apparatus for reducing a rate of descent of said person, said friction core having a helical groove for receiving a portion of said rope which is withdrawn from said descender apparatus.

10. In a rescue apparatus, for lowering and controlling a rate of descent of a person from an elevated position to a lower position, a harness for attaching a descender apparatus to a person, said harness having a portion adapted to be positioned in adjacent covering relationship to a chest of said person, a descender apparatus for said lowering and controlling said rate of descent, said descender apparatus having a pair of bosses on an upper portion of said descender apparatus for attaching said descender apparatus to said harness and a downward extending tang portion on a lower portion of said descender apparatus for attaching said lower portion of said descender apparatus to said harness, in plain view of said person, said descender apparatus having a rope stored in said descender and being withdrawn from said descender apparatus during said lowering of said person, a means for limiting a rate of descent of said person, and a means for adjusting said rate of descent during said lowering of said person.

11. The rescue apparatus recited in claim 10 wherein said improvement further comprises a three point mounting system for attaching said apparatus to said person, said three point mounting system comprising a pair of torso straps for embracing a torso of said person and a single crotch strap for subtending a crotch of said person.

* * * * *